US005657298A

United States Patent [19]

Choay

[11] Patent Number: 5,657,298

[45] Date of Patent: Aug. 12, 1997

[54] WATCH WITH INTERCHANGEABLE ELEMENTS

[75] Inventor: Nathalie Choay, Paris, France

[73] Assignee: S.A. Sussex France, Paris, France

[21] Appl. No.: 498,472

[22] Filed: Jul. 5, 1995

[30] Foreign Application Priority Data

Jul. 8, 1994 [FR] France ..... 94 08455

[51] Int. Cl.[6] ..... G04B 37/00; G04B 29/00

[52] U.S. Cl. ..... 368/276; 368/282; 368/300

[58] Field of Search ..... 368/88, 276, 281–282, 368/299, 300

[56] References Cited

U.S. PATENT DOCUMENTS 4,396,298 8/1983 Ridley ..... 365/300

FOREIGN PATENT DOCUMENTS 2174336 10/1973 France .

7143428 2/1972 Germany .

276471 7/1951 Switzerland ..... 368/281

371055 4/1963 Switzerland .

481416 9/1969 Switzerland ..... 368/282

538139 2/1973 Switzerland .

2200032 7/1988 United Kingdom .

83-02014 6/1983 WIPO ..... 368/282

*Primary Examiner*—Vit W. Miska

*Attorney, Agent, or Firm*—Young & Thompson

[57] ABSTRACT

A watch comprising a case (4) containing a movement and a dial, a strap (3) to secure the case (4) to the wrist as well as an assembly cover (2) adapted to be secured to the case (4) and the strap (3). The assembly cover (2) is provided with reception recesses (11) for the strap (3) and a snap-in connection (10) for the case (4). The case (4) in use masks the recesses (11) of the strap (3). The assembly cover (2) comprises on opposite sides of its internal surface two side walls (9) defining openings (11') permitting the passage of the strap (3).

3 Claims, 1 Drawing Sheet

FIG. 1
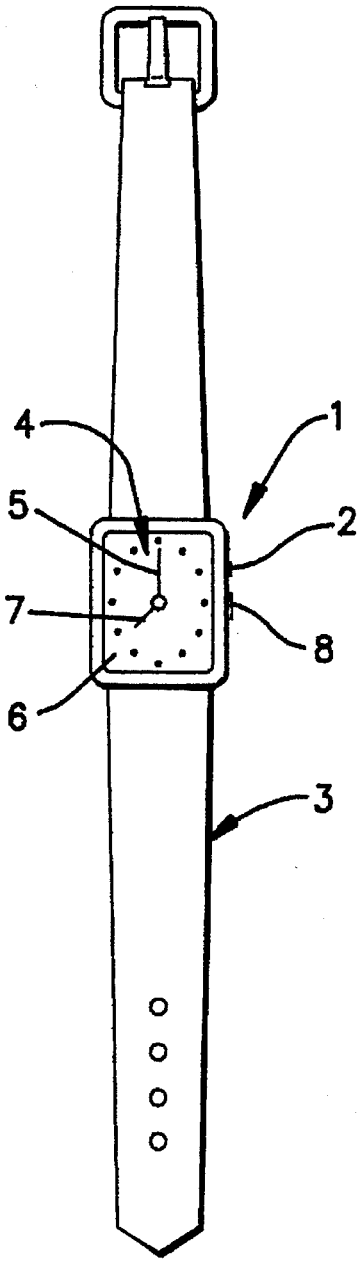
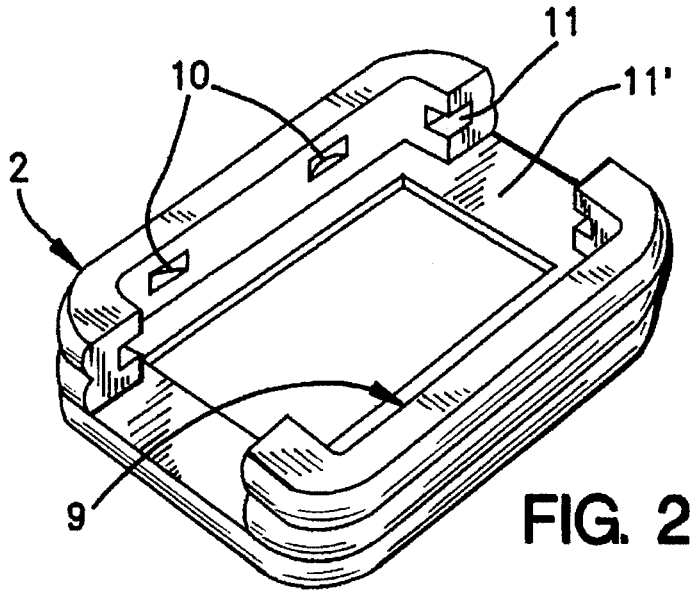
FIG. 2
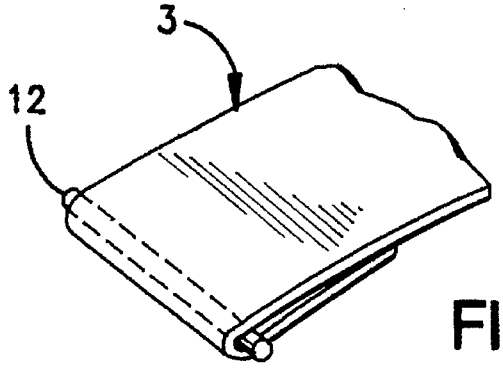
FIG. 3
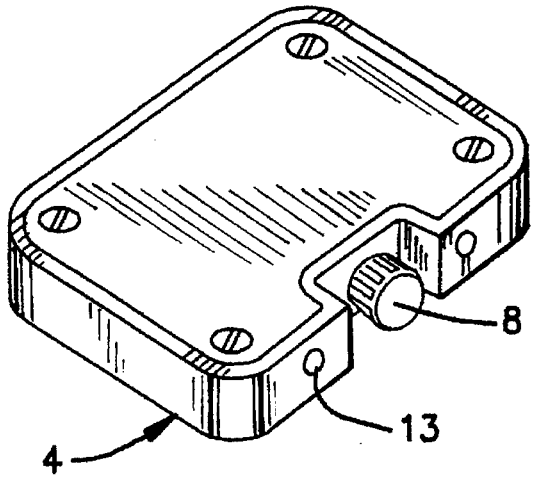
FIG. 4

WATCH WITH INTERCHANGEABLE ELEMENTS

The invention relates to watches with interchangeable elements.

The strap of a watch being subject to wear, it is provided with means to replace the strap when the latter is worn.

Generally, two retractable pins are passed through the ends of the strap opposite the closure buckle, the ends of these pins lodging in recesses provided for this purpose in the ears of the shoulder of the case.

Given the difficulty of manipulating these pins, the replacement of a watch strap is more often carried out by specialized workers (jewelers-watch makers).

Recently there have been sold watches with a set of several straps easily interchangeable by the user himself.

In one design of this type,. two hollow tubes are mounted on each side of the watch case and the ends of the straps, which are shaped to the profile of the tubes, are fitted thereto.

The present invention provides a watch of which not only the strap but also the movement and the dial are easily interchangeable by the user, without the use of any tool.

To this end, the invention is constituted by a watch comprising a case containing a movement and a dial, a strap to secure the case to the wrist as well as an assembly cover adapted to interconnect the case and the strap, characterized in that said cover is provided with recesses for the reception of the strap and snap-in means of the case, wherein said case is closing said recesses for the reception of the watch strap when the watch is assembled.

Preferably, the invention is embodied with the following characteristics:

- The assembly cover comprises on opposite sides of its internal surface two side walls defining openings permitting the passage of the strap;
- Said side walls comprise on the one hand snap-in means for the case which are preferably grooves and on the other hand at each of its ends recesses for the reception of the strap which are preferably notches;
- The case comprises on two of its opposite sides spring-urged balls adapted to snap into the snap-in means of the assembly cover provided for this purpose;
- The strap is provided at each of its ends with rigid bars or pins adapted to enter the reception recesses of the assembly cover;
- The watch strap according to the invention can be of leather or metal;
- The assembly cover according to the invention can be of any desired shape so long as it has a reception recess corresponding to the external contour of the case.

Other characteristics and advantages of the invention will become apparent from the description which follows of a non-limiting example of embodiment with reference to the accompanying drawings, in which FIG. 1 is a schematic plan view of a watch according to the invention;

FIG. 2 is a schematic perspective view from above of the assembly cover of the watch of FIG. 1;

FIG. 3 is a fragmentary perspective schematic view of one leg of the strap of the watch of FIG. 1;

FIG. 4 is a schematic perspective view from below of the case of the watch of FIG. 1;

FIGS. 2, 3 and 4 constitute an exploded assembly view illustrating the mounting of the watch according to the invention.

According to FIG. 1, it will be seen that the watch 1 is constituted of an assembly cover 2, a strap 3 and a case 4.

Said case 4 comprises the hands' movement 5, the dial 6, the hands 7, the crystal protecting the hands and the hands adjustment means 8.

According to FIG. 2, it can be seen that the assembly cover comprises on its lower surface two side walls 9 disposed on opposite sides of said assembly cover 2. Said lateral walls 9 are provided on each of their internal sides with two grooves 10 and at each of their ends with notches 11. Moreover, said lateral walls 9 define two opposite openings 11' for the passage of the ends of the strap 3.

The strap 3, as illustrated in FIG. 3, comprises at each of its ends a rigid pin 12 fixed in the end fold of the strap, the outwardly extending ends of the pin lodging in notches 11 of the assembly cover 2.

As a modification, the end pins 12 of the strap can be replaced by lugs projecting on opposite sides of each end of the strap and arranged to coact with the notches 11. These lugs can be retractable or not.

Finally, and according to FIG. 4, it can be seen that the case 4 comprises on two of its opposite sides spring-urged balls 13 adapted to click into the grooves 10 of the assembly cover 2.

According to the invention, the mounting of the watch 1 takes place in the following order:

1st/ Emplacement of the strap 3 by means of the rigid pins 12 which are slid into the notches 11 of the assembly cover.

2nd/ Introduction of the case 4 into the assembly cover 2 by means of the spring-urged balls which are snapped into the grooves 10 by simple pressure on the rear surface of said case 4. When the case 4 is secured in the assembly cover 2, it obstructs the notches 11 of the assembly cover 2, which renders the strap 3 itself secured to the assembly cover 2.

To change one of the elements of the watch, for example the case, it suffices to carry out the reverse operation, which is to say to separate the case 4 from the assembly cover 2 of the watch by simple pressure on the forward surface of said case 4, which then frees the notches 11, which permits withdrawal of the strap 3 and replacement of said strap.

Thanks to the invention, there is obtained a new type of watch which, from three modular elements interchangeable without a tool, namely the assembly cover 2, the strap 3 and the case 4, makes it possible for the user easily to obtain a multitude of combinations according to the different assembly covers, cases and straps that he has. Moreover, the watch according to the invention is not limited to the examples of designs described above, thus the assembly cover of the watch can have any desired shape provided it has a reception recess corresponding to the external contour of the case. The strap of the watch can be of leather or metal, it can have a system for securement to the wrist by means of a buckle or be an expansible strap without a buckle.

Finally, the case can be provided with adjustment means for the hands or comprise automatic adjustment means or else the case can have a digital time display.

In this embodiment, there is provided on the two surfaces of the assembly cover grooves coacting with spring-urged balls arranged on two corresponding surfaces of the case. Other snap-in means can be provided without departing from the assembly cover of the invention; for example, spring-urged balls on one of the surfaces of the case can be replaced by fixed projections which come into engagement in the corresponding grooves of the assembly cover. Thus, the changing of the case or of the assembly cover takes place by swinging about the axis defined by the projections instead of the insertion in a direction perpendicular to the display surface of the assembly cover.

I claim:

1. In a watch comprising a case (4) containing a movement and a dial, a strap (3) to secure the case (4) to the wrist, an assembly cover (2) adapted to be secured to the case (4), the strap (3) having pins (12) by which the strap (3) is secured to the cover (2); the improvement wherein said assembly cover (2) has reception recesses (11) for receiving ends of the pins (12) of the strap (3), said recesses opening toward each other and toward said case (4) but being closed on their sides opposite said case (4), and snap-in means (10) for the case (4) such that said case closes said reception recesses (11) for the pins (12) of the strap (3) when the watch is assembled.

2. A watch according to claim 1, wherein said snap-in means (10) comprise grooves.

3. A watch according to claim 1, wherein the case (4) comprises on two of its opposite sides spring-urged balls (13) adapted to click into said snap-in means (10) of the assembly cover (2).

* * * * *